United States Patent [19]

Cavanagh

[11] Patent Number: 4,608,768

[45] Date of Patent: Sep. 2, 1986

[54] ATHLETIC SHOE HAVING A SHOCK-ABSORBING RUNNING SOLE AND A PROCESS FOR MANUFACTURING SAID ATHLETIC SHOE

[75] Inventor: Peter R. Cavanagh, Pine Grove Mills, Pa.

[73] Assignee: Puma-Sportschuhfabriken Rudolf Dassler KG, Fed. Rep. of Germany

[21] Appl. No.: 630,398

[22] Filed: Jul. 13, 1984

[30] Foreign Application Priority Data

Oct. 24, 1983 [DE] Fed. Rep. of Germany ..... 3338557

[51] Int. Cl.[4] ..... A43B 13/18; A43B 13/12; A43B 13/04

[52] U.S. Cl. ..... 36/28; 36/30 R; 36/30 A; 36/32 R; 36/129

[58] Field of Search ..... 36/28, 30 R, 30 A, 32 R, 36/31, 59 A, 114, 129, 91

[56] References Cited

U.S. PATENT DOCUMENTS

| | | | |
|---|---|---|---|
| 1,370,798 | 3/1921 | Egerton | 36/32 R |
| 2,411,479 | 11/1946 | Tarlow | 36/30 A |
| 2,721,400 | 10/1955 | Israel | 36/28 X |
| 2,885,797 | 5/1959 | Chrencik . | |
| 4,187,620 | 2/1980 | Selner | 36/28 |
| 4,297,796 | 11/1981 | Stirtz et al. . | |
| 4,364,188 | 12/1982 | Turner et al. . | |
| 4,364,189 | 12/1982 | Bates . | |
| 4,535,553 | 8/1985 | Derderian et al. | 36/28 |

FOREIGN PATENT DOCUMENTS

| | | | |
|---|---|---|---|
| 2904540 | 8/1980 | Fed. Rep. of Germany . | |
| 2114869 | 9/1983 | United Kingdom | 36/114 |

*Primary Examiner*—James Kee Chi

*Attorney, Agent, or Firm*—Sixbey, Friedman & Leedom

[57] ABSTRACT

An athletic shoe having a shock-absorbing running sole which has at least one intermediate support extending at least approximately in parallel with a major plane of the running sole. The intermediate openwork support is disposed in a softly elastic midsole provided between an insole and a running sole. For obtaining a targeted reduction of shock stresses occurring to a varying degree in the individual sole sections, plugs are inserted into the openwork support. The plugs are made of a material that is harder than that of the midsole and are disposed vertically with respect to the noted major plane thereof, at least in the sections that are highly or maximally stressed during the running and possibly also in the adjacent zones.

32 Claims, 8 Drawing Figures

ATHLETIC SHOE HAVING A SHOCK-ABSORBING RUNNING SOLE AND A PROCESS FOR MANUFACTURING SAID ATHLETIC SHOE

BACKGROUND AND SUMMARY OF THE INVENTION

This invention relates to an athletic shoe having a shock-absorbing running sole that has at least one component incorporated into the body of the sole so as to modify its mechanical properties of stiffness, shock absorbency and the like, as well as to a process for manufacturing said athletic shoe.

An athletic shoe having a sole representing one form of the above-explained type running sole is known from U.S. Pat. No. 4,297,796. In the case of this athletic shoe, a netting or open mesh structure made of stretch-resistant threads or similar means is connected to the top side of a flexibly deformable sole layer. The netting or mesh structure is also folded down around the periphery of the sole layer. The netting structure has the purpose of distributing the shock stresses which, in individual sections, such as in the section of the heel or in the section of the ball, are especially high, over a larger area. An athletic shoe of this type, after the manufacture, cannot be changed as far as its shock-absorbing characteristics are concerned, and, while the netting structure may serve a shock distributing function, it does not provide a means for varying the shock absorbency of localized portions of the sole.

It is also known, such as from U.S. Pat. Nos. 2,885,797; 4,364,188 and 4,364,189, as well as German Offenlegungsschrift (Laid-Open patent application) No. 29 04 540, to be able to vary the shock absorbency of localized portions of a resilient sole or sole layer (such as the midsole of a running shoe) by the subsequent incorporation of plugs of a harder material into openings formed in the otherwise homogeneous material of the body of the resilient sole. While such a technique provides a high degree of flexibility in adapting the stiffness and shock absorbency of various parts of a given sole to the needs of a given runner, it is not well suited to mass production of large numbers of soles, nor is there any load distributing effect when individual plugs are utilized. Furthermore, if a mere friction fit is used to hold the plugs in place, they may become dislodged during use, particularly in areas of the sole that are highly flexed. On the other hand, if adhesives are used, a permanent bond results that precludes re-adapting the sole to subsequent needs, not to mention the fact that the fastening procedure can be messy and time-consuming. On the other hand, if the insert plugs were to be incorporated or molded-in during formation of the body of the resilient sole, the costs and/or complexity of the molds required for every single size and/or combination of characteristics of the shoe would be dramatically increased.

This invention has an objective of adapting the stiffness and shock absorbency of a resilient sole or sole layer, particularly individual sections of the sole to the shock stress respectively experienced thereby. Furthermore, the invention seeks to attain this objective both from the mass manufacture standpoint as well as from that of enabling the shock-absorbing characteristics to be subsequently adapted to the individual physical needs of the user or to the specific type of sport for which the shoe incorporating the sole is to be used.

According to preferred embodiments of the invention, these objectives are achieved by a process and athletic shoe wherein an openwork structure, such as a meshwork or netting, is embedded into at least a portion or portions of a resilient sole during molding thereof, and plugs of a harder material than the body of the sole are inserted vertically into openings of the openwork structure, prior to and/or subsequent to molding of the sole about the openwork structure.

In spite of the use of a uniform material for the midsole, the invention makes it possible to give the different sections of the running sole different shock-absorbing characteristics according to anticipated stressing thereof. When using exchangeable plugs, it is possible that the user may find and adjust the blend of shock-absorbing characteristics that is optimal for him or her, and may still be able, according to the different running conditions, as in the case of a hard or soft ground or similar conditions, to adapt the shock-absorbing characteristics in the different sections of the sole.

Moreover, by appropriate shaping of the insert plugs, an interlocking engagement with the openwork structure can be achieved that will effectively hold subsequently inserted plugs in place within the sole without the use of adhesives; while, in the situation where the plugs are to be embedded during manufacture of the sole, they can be pre-assembled into the openwork to form pre-assmebled units in any number of combinations, thereby enabling a standardized mold to form soles possessing numerous different characteristics.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
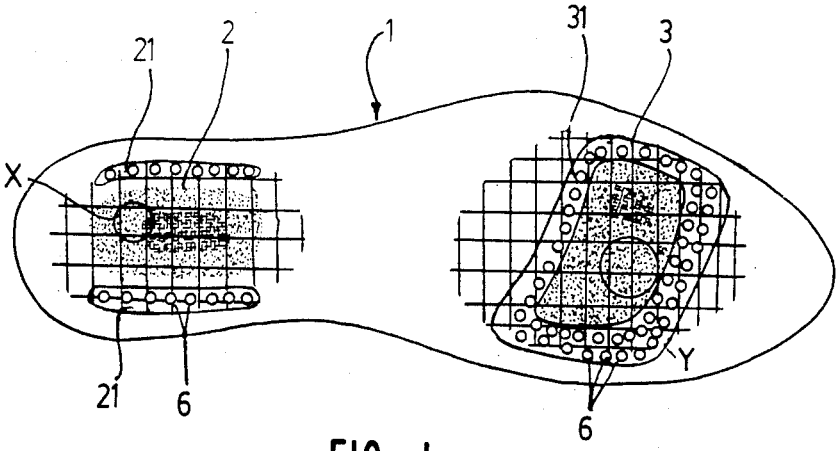
FIG. 1 shows a diagrammatic view from the top of a running sole of an athletic shoe illustrating an example of a pattern of high and maximum shock stresses as may be imposed during running.
Figure 2:
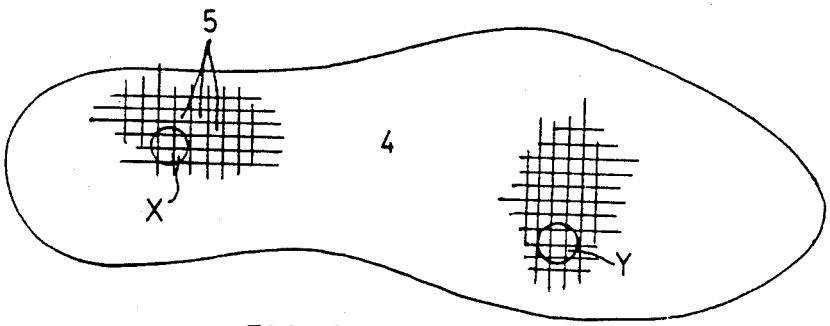
FIG. 2 shows a sole incorporating openwork structures for shock-absorbing elements in a sole.
Figure 3:
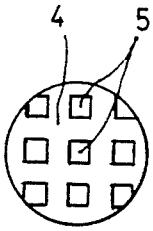
FIGS. 3 and 4 show an enlarged representation of the details X and Y, respectively, of FIG. 2, illustrating openwork structures with square and round mesh openings.
Figure 4:
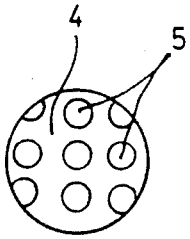

In FIG. 1, a running sole of an athletic shoe, especially for longer-distance running, has the reference numeral 1. During running, especially high shock stresses occur in the section of the heel 2 and in the section of the ball 3. The darker sections, where the points are close to one another, represent the sections that are particularly highly stressed. In order to be able to reduce these shock stresses of the heel and of the ball of the foot more effectively than previously and in order to avoid, in the midsole 7, a "wearing-through", an intermediate support 4, in the form of an openwork structure (diagrammatically shown in FIG. 2), is provided in the running sole 1, within the midsole 7, and at least in the sections 2, 3 (FIG. 1); but, preferably, also in the adjacent zones 21, 31, at or around the heel and ball, plugs being provided or being able to be provided so as to serve as a shock-absorbing means. The openwork structure preferably has a mesh form as shown in the circular sections of FIGS. 3 and/or 4, which show an enlarged section of the circles X, Y of FIGS. 1 and 2. In FIG. 3, the openings 5 in the mesh are square, and in FIG. 4 they are circular. The spacing of the openings 5 may be selected according to the desired distribution of pressure.

Advantageously, the intermediate support 4 consists of a punched-out section of netting. Alternatively, the support 4 and its openings 5 may be punched-out or otherwise made in a suitable manner from a full strip of solid material, either at the same time or first the support 4 and subsequently the openings 5. Furthermore, openings 5 may be provided at all points or only in preferred zones where shock-absorbing means are to be inserted later.

While the intermediate support 4 may be formed of flexible yet stretch-resistant netting, material, especially a woven material, such as of nylon or other synthetic fibers, it is preferred that the intermediate support be formed of a layer of an elastic, but relatively rigid, i.e., shape-sustaining material, such as polyurethane or another foamed material. The intermediate support 4 is provided approximately in the area of the middle third of the softly elastic, preferably volume-compressible midsole 7. Preferably, midsole 7 consists of a highly porous material, such as foamed polyurethane or another softly elastic plastic foam, as is known for use in the midsole layer of the sole of a running shoe. The material of the midsole 7 may preferably be molded around the intermediate support 4, or the midsole may be formed in two parts, the parts being fastened to the intermediate support 4 on opposite sides thereof, preferably by gluing. The plugs 6 may be inserted into the intermediate support 4 before or after its attachment to the midsole 7.

Figure 5:
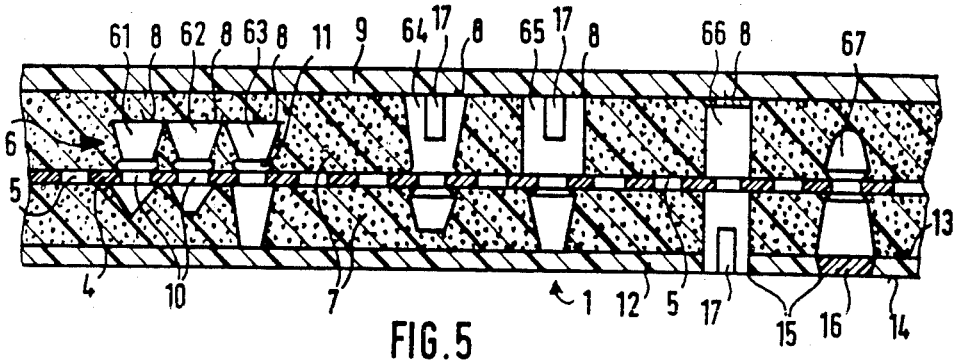
FIG. 5 shows a cross section through a sole showing (in elevation) different embodiments of shock-absorbing plugs embedded therein.

FIG. 5 shows a selection of possible shock-absorbing means, preferably developed as plug 6, and their arrangement in the openwork structure forming intermediate support 4, as well as the arrangement of the intermediate support 4 in the running sole or midsole 7.

The form of the plugs 6 is such that they can, preferably, exchangeably snap into an opening 5 in the openwork support structure. Preferably, they have the shape of two cones or pyramids arranged on top of one another and tapering toward the bottom in the direction of the outer sole 12. In this connection, see plugs 61, 62, 63 and 64 in FIG. 5. This configuration results in larger upper bearing surfaces 8, which ensure a large-surface exposure toward the insole 9, located above midsole 7, so as to act to eliminate peak stress points. These plugs may be in direct contact with the insole 9 (plug 64) or they may be separated therefrom by a portion of the midsole 7 (plugs 61–63).

Approximately in the lower part of the center third, up to half the height of the plug, the plugs 6 have a catch groove 10, preferably in the form of a surrounding ring-shaped groove, by means of which they can snap into an opening 5 in the openwork structure 4. If required for a better fixing, a catch bead 11 may be provided above groove 10 to engage the openwork intermediate support 4. Instead of the catch groove 10, or in addition, other catching and/or clamping elements may also be provided for the fastening of the plug 6 to the intermediate support 4.

The lower part of the plug pointing, toward the outer sole 12 may be shaped to have a blunt bottom (see plugs 67—67) and may end at a distance from the inside surface 13 of the outer sole 12, as in the case of plug 64, or it may extend to the inside surface 13 of the outer sole 12, as in the case of plugs 63, 65, or it may project to the outside running surface 14 of outer sole 12 and, itself, serve as a part of the running surface, as in the case of plug 66. Finally, the plugs, like plugs 66 and 67, may also be subsequently insertable through an opening 15 of the running sole 12, in which case the opening 15 may also be closed off from the outside by means of a blind plug 16, where the subsequently inserted plugs do not extend to surface 14.

When the plugs 6 are to be inserted subsequently from above, the insole 9 is attached so that it can be removed. This may be achieved, for example, by having the insole simply rest upon the midsole, or by means of catch or snap elements or by means of burr-type closure strips of the type known under the trademark "Velcro", which are provided between the insole 9 and the midsole 7, or the lasting fold of the material of the upper of the athletic shoe (not shown). In order to be able to easily remove the plugs 6, a recess 17 may be provided at an end for the insertion of an extraction screw, tool or similar means. The plugs 64 to 66 could, for example, be subsequently inserted from above.

Figure 6:
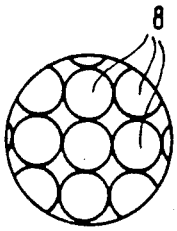
FIGS. 6 and 7 show possible close arrangements for upper supporting surfaces of the shock-absorbing plugs.
Figure 7:
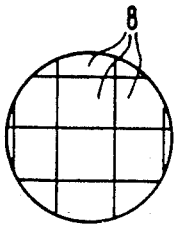

In order to achieve a distribution of pressure on the insole 9, that is as uniform as possible, the bearing surfaces 8 may be developed in such a way that plugs 6, fitted into adjacent openings 5 in the openwork, touch one another or are at least very close together, as this is shown in diagram form in FIGS. 6 and 7 for round or square bearing surfaces 8. A corresponding situation is also shown in FIG. 5 concerning plugs 61, 62, 63.

The plugs 6 consist of a suitable, shock-absorbing material that is harder than that of the midsole 7, preferably of an elastic unfoamed or only slightly foamed material, such as nylon, polyurethane, polyethylene, polypropylene or a similar material.

Figure 8:
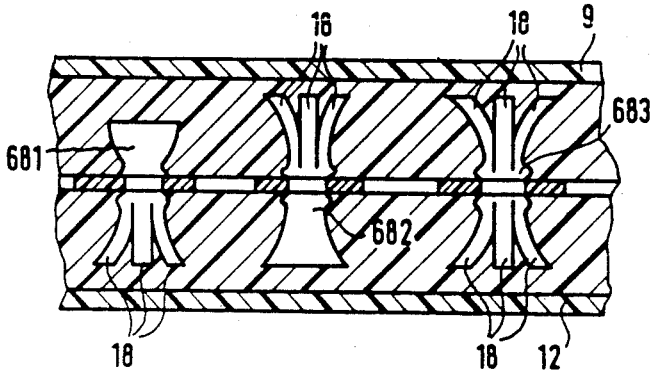
FIG. 8 shows, in cross section, a sole having shock-absorbing plugs with springy projecting arms (the plugs being shown in elevation).

A very even shock distribution can be achieved when, according to FIG. 8, the plugs 6 are developed in such a way that, when viewed from the direction of the intermediate support 4, they each have at least two springy arms 18 projecting diagonally toward the periphery of the sole 1, at least toward one side. When such arms 18 are provided, the plugs 6 are practically anchored in the midsole 7 and reinforce this midsole 7 over a wider area. These springy arms 18 may, according to the plug 681 (shown on the left in FIG. 8), be aligned toward the bottom in the direction of the outer sole 12 or, as in the case of the center plug 682, toward the top and inner sole 9. Still further, as in the case of the right plug 863, arms 18 may project toward the top and toward the bottom.

The manufacture of a running sole 1 having the plugs 6, according to the invention, takes place, for example, by first manufacturing an intermediate support 4 in the form of an openwork having the openings 5 in at least zones 2 and 3, and preferably also in zones 21 and 23.

Subsequently, according to the desired shock-absorption or required location, plugs 6 of one or more of the above-noted types are inserted into the openings 5 in the openwork intermediate support 4, said plugs 6 having a suitable hardness, i.e., are made of a material that is harder than that of the midsole 7, and being inserted in a desired pattern either by hand or machine to form an insert pre-assembly. Subsequently, the pre-assembly of the intermediate support 4 and plugs 6 is surrounded by a softly elastic midsole material so that it becomes embedded therein, for example, by molding or casting. The outer sole 12 is then attached, unless it has been molded onto the midsole at the same time, as may also an upper part (that is shown in the drawings). A conventional heel wedge may also be attached to, or be shaped as one piece with, the midsole 7, or may, preferably, be molded thereon.

It is advantageous for the sections 2, 3 of the running sole 1, that are highly or maximally stressed, to have plugs 6 that are made of material that is less hard and/or less dense than that of the adjacent sections 21, 31 in the heel and ball area. This results in the important effect that the highly or maximally stressed sections of the running sole 1 have a shock-absorbing characteristic that is softer than that of the adjacent sections 21, 31, where the supporting effect of the plugs 6 is more extensive. Plugs 6, of a material of varying hardness and/or density, are advantageously provided in such a way that, in the inside (medial) section of the ball, plugs 6 are provided which are less hard and/or less dense than those in the outside (lateral) section of the ball.

A similar effect of controlling the degree of shock absorbing may also be achieved by the fact that the peg density, i.e., the number of plugs per $cm^2$, in the highly or maximally stressed sections 2, 3, is less than that in the adjacent sections 21, 31.

By means of the plugs 6, provided in the preferred zones 2, 3, and 21, 31, of the running sole in the intermediate support 4, the "aging process" of the material of the midsole 7 is also favorably affected and even significantly delayed. That is, conventionally used foamed midsole materials, generally, lose about 50% of their shock-absorbing qualities during approximately the first 300 km of running, because the individual cell walls permanently buckle. This effect occurs especially in the highly stressed areas of the running sole 1. By means of the arrangement of the plugs 6, the stress to which the foamed midsole 7 is subjected in these sections, 2, 3 and 21, 31, is reduced and, thus, the deforming effect on the cell walls of the foamed material of the midsole 7 is decreased. The elasticity or the compressibility of the midsole 7, therefore, will be maintained much longer than is the case in the known arrangements.

The intermediate support 4 may also be subdivided into several segments, for example, one segment for the heel and another segment for the ball. It is also possible to arrange more than one intermediate support 4 in the section of the midsole 7 in order to still improve the alignment of the plugs 6 approximately normal to the level of the running sole 1.

A special advantage of the present invention is the fact that the shock-absorbing effect along the running sole 1 can be controlled and optimized corresponding to the specific requirements of the individual parts of the sole, without the manufacture of such running soles requiring extremely expensive molds, because the "shock-absorbing profile" over the whole area of the running sole 1 can be determined and even subsequently adapted by means of the intermediate support 4 and the specifically selected plugs 6. Therefore, construction of the injection or casting molds need only be determined by the profile of the running sole 12 and the thickness and shape of the midsole 7. Moreover, since the plugs of at least a given portion of the sole are interlocked within a common support structure, a cooperative load distributing effect is achieved to a certain extent, even when the plugs are not very closely spaced. Also, this interlocking relationship between the support structure and the plugs facilitates manufacture by allowing numerous different pre-assemblies to be created in an inexpensive manner, while simplifying the process of locating and holding of the plugs within a mold in comparison to the use of a multitude of individual plugs.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe having a shock-absorbing running sole that has at least one flexible intermediate openwork support extending at least approximately in parallel with a major plane of the running sole, wherein the intermediate openwork support is arranged in a softly elastic midsole that is provided between an insole and an outer sole, and plugs made of a material that is harder than that of the midsole are provided, said plugs being insertable, in a direction normal to said plane of the sole, into openings in the intermediate openwork support at least in sections of the running sole that are highly or maximally stressed during running.

2. An athletic shoe according to claim 1, wherein the plugs have a large-area bearing surface facing toward the insole.

3. An athletic shoe according to claim 1, wherein the plugs are tapered at least from a point of securement of the plugs in the intermediate openwork spport toward the outer sole.

4. An athletic shoe according to claim 2, wherein the plugs are tapered at least from a point of securement of the plugs in the intermediate openwork support toward the outer sole.

5. An athletic shoe according to claim 1, wherein the plugs rest, at a top end, against a side of the insole that faces toward the outer sole.

6. An athletic shoe according to claim 2, wherein the plugs rest, at a top end, against a side of the insole that faces toward the outer sole.

7. An athletic shoe according to claim 1, wherein the bottoms of the plugs rest against the inside of the outer sole.

8. An athletic shoe according to claim 6, wherein the bottoms of the plugs rest against the inside of the outer sole.

9. An athletic shoe according to claim 1, wherein at least some of said plugs are engaged in said opening so as to cause bearing surfaces on ends thereof facing the insole to adjoin one another.

10. An athletic shoe according to claim 3, wherein at least some of said plugs are engaged in said opening so as to cause bearing surfaces on ends thereof facing the insole to adjoin one another.

11. An athletic shoe according to claim 1, wherein the material of the midsole is molded around the intermediate support and plugs inserted therein.

12. An athletic shoe according to claim 1, wherein the running sole is constructed so as to enable insertion of at least some plugs into the intermediate support through the midsole.

13. An athletic shoe according to claim 11, wherein the running sole is constructed so as to enable insertion of at least some plugs into the intermediate support through the midsole.

14. An athletic shoe according to claim 12, wherein said insole is removable for enabling said insertion of some plugs through the midsole into the intermediate support.

15. An athletic shoe according to claim 13, wherein said insole is removable for enabling said insertion of some plugs through the midsole into the intermediate support.

16. An athletic shoe according to claim 12, wherein the outer sole has openings for enabling said insertion of at least some plugs through the midsole into the intermediate support.

17. An athletic shoe according to claim 13, wherein the outer sole has openings for enabling said insertion of at least some plugs through the midsole into the intermediate support.

18. An athletic shoe according to claim 16, wherein blind plugs are provided for closing said openings in the running sole.

19. An athletic shoe according to claim 17, wherein blind plugs are provided for closing said openings in the running sole.

20. An athletic shoe according to claim 1, wherein the intermediate openwork support is formed of an elastic material and the plugs are shaped for snap-in engagement within the openings of the openwork support.

21. An athletic shoe according to claim 1, wherein the plugs have the shape of two cones or pyramids arranged above one another.

22. An athletic shoe according to claim 20, wherein the plugs have the shape of two cones or pyramids arranged above one another.

23. An athletic shoe according to claim 20, wherein said plugs have a catch groove approximately in a middle third of their longitudinal extent.

24. An athletic shoe according to claim 22, wherein said plugs have a catch groove approximately in a middle third of their longitudinal extent.

25. An athletic shoe according to claim 1, wherein at least some of said plugs, at least on one side of the intermediate support, have at least two springy arms projecting diagonally toward the outside.

26. An athletic shoe according to claim 23, wherein at least some of said plugs, at least on one side of the intermediate support, have at least two springy arms projecting diagonally toward the outside.

27. An athletic shoe according to claim 1, wherein plugs inserted into said openwork support in the section of the running sole are made of a material that has at least one of the properties of hardness and density which is less than that of the plugs inserted into the openwork support at adjacent sections of the heel and ball area of the running sole.

28. An athletic shoe according to claim 1, wherein plugs of materials which vary with respect to at least one of their properties of hardness and density are provided in such a way that, at a medial side section of the ball, plugs are arranged that have a lesser value of said properties than those at a lateral side section of the ball.

29. An athletic shoe according to claim 1, wherein the plug density in the highly or maximally stressed sections is less than that of plugs inserted in adjacent sections of the intermediate openwork support.

30. An athletic shoe according to claim 1, wherein said intermediate support is a layer of elastic, relatively rigid, material.

31. An athletic shoe according to claim 30, wherein said elastic, relatively rigid, material is a foamed synthetic plastic.

32. An athletic shoe according to claim 1, wherein plugs inserted into the openwork support are situated in said midsole in said sections that are highly or maximally stressed and in areas adjacent thereto; and wherein the plugs in the highly or maximally stressed sections are constructed and arranged, relative to the plugs of the adjacent areas, so as to render said highly or maximally stressed sections more shock-absorbent than said adjacent areas.

* * * * *